US006000199A

United States Patent [19]

Boldrini

[11] Patent Number: 6,000,199

[45] **Date of Patent: *Dec. 14, 1999**

[54] WRAPPING METHOD FOR PRODUCING PACKETS

[75] Inventor: Fulvio Boldrini, Ferrara, Italy

[73] Assignee: G.D Societa'Per Azioni, Bologna, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/498,201

[22] Filed: Jul. 5, 1995

[30] Foreign Application Priority Data

Jul. 7, 1994 [IT] Italy ..... B094A0316

[51] Int. Cl.[6] ..... B65B 11/10; B65B 11/28

[52] U.S. Cl. ..... 53/466; 53/234

[58] Field of Search ..... 53/234, 466, 233

[56] References Cited

U.S. PATENT DOCUMENTS

| | | | |
|---|---|---|---|
| 3,813,849 | 6/1974 | Stambera et al. | 53/234 |
| 3,899,865 | 8/1975 | Revaz | 53/234 |
| 3,948,115 | 4/1976 | Seragnoli | 53/234 |
| 4,079,575 | 3/1978 | Focke et al. | 53/234 |
| 4,092,816 | 6/1978 | Seragnoli | 53/234 |
| 4,509,310 | 4/1985 | Focke et al. | 53/234 |
| 4,887,408 | 12/1989 | Mattei et al. | 53/466 |
| 5,003,755 | 4/1991 | Draghetti | 53/466 |
| 5,269,117 | 12/1993 | Boriani et al. | 53/234 |

FOREIGN PATENT DOCUMENTS

| | | | |
|---|---|---|---|
| 1486469 | 1/1990 | United Kingdom . | |
| 2220911 | 1/1990 | United Kingdom | 53/234 |

*Primary Examiner*—Jessica J. Harrison
*Assistant Examiner*—John Paradiso
*Attorney, Agent, or Firm*—Ladas & Parry

[57] ABSTRACT

A wrapping method for producing soft packets presenting an inner packet and an outer wrapping, whereby each inner packet is fed into a respective seat on a wrapping conveyor at a transfer station and together with a sheet of gummed wrapping material which is folded in a U about the inner packet; the sheet of wrapping material being subjected to a number of folding operations to form a tubular wrapping about the inner packet and to axially close the tubular wrapping by folding one end of it; and the folding operations being performed as the seat travels a minimum number of steps from the transfer station.

13 Claims, 7 Drawing Sheets

FIG. 2a
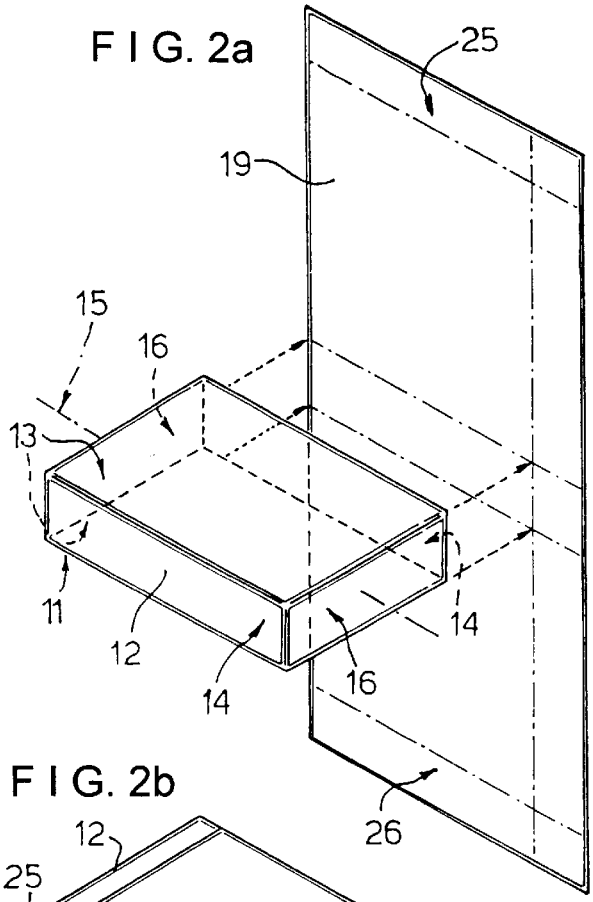
FIG. 2b
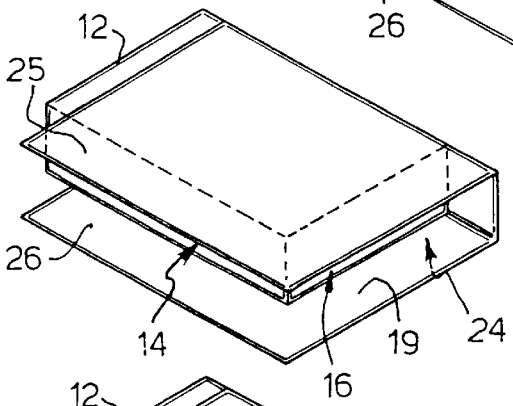
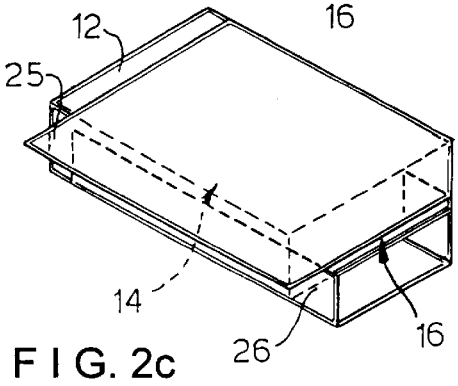
FIG. 2c
FIG. 2d
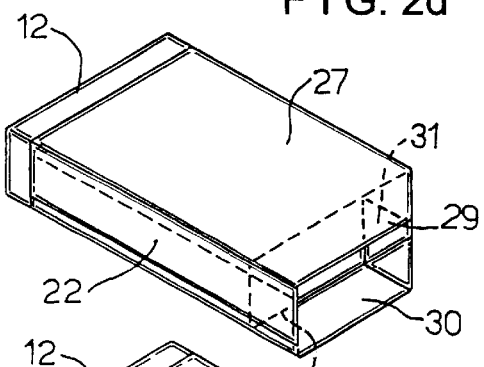
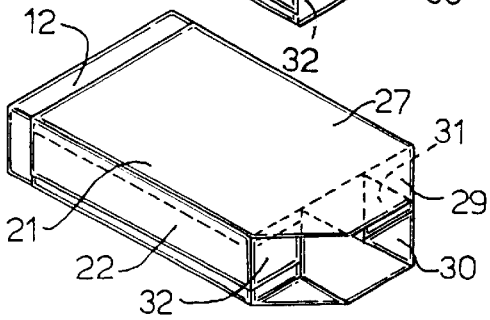
FIG. 2e
FIG. 2f
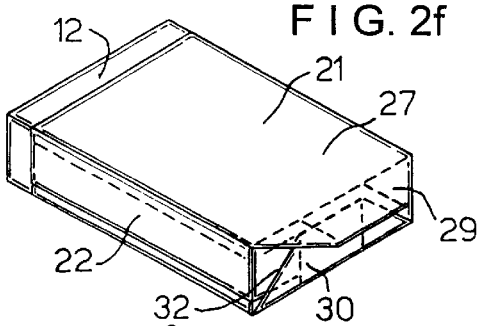
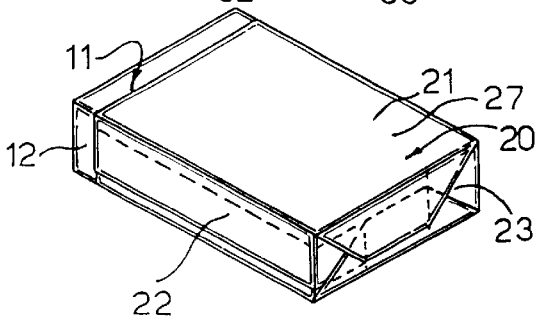
FIG. 2g

WRAPPING METHOD FOR PRODUCING PACKETS

BACKGROUND OF THE INVENTION

The present invention relates to a wrapping method for producing packets.

The present invention is particularly advantageous for producing so-called "soft" packets of cigarettes, to which the following description refers purely by way of example.

In the manufacture and conditioning of tobacco items in general, and cigarettes in particular, so-called "soft" packets are produced comprising an inner wrapping—normally made of foil and enclosing a group of cigarettes arranged side by side in a number of rows—and an outer wrapping—normally formed from a sheet of wrapping material folded to form a cup-shaped body enclosing part of the inner wrapping, the rest of which projects outwards from the open end of the outer wrapping.

Soft packets are produced on packing machines comprising a wrapping wheel with a number of peripheral seats, each of which is fed with a respective group of cigarettes in a respective inner wrapping, and with a sheet of wrapping material with given surface portions gummed beforehand. To form the outer wrapping, the wrapping wheel normally folds the sheet of wrapping material on to the inner wrapping by feeding the seats in steps through a succession of folding stations which are normally substantially equally spaced between a loading station, at which the groups of cigarettes are loaded on to the wrapping wheel, and an unloading station at which the finished packets are unloaded.

The above wrapping wheel design of known packing machines poses problems in the event, for any reason, the wheel is arrested during production. Since the sheets of wrapping material are gummed before being fed on to the wheel, and, on account of the substantially equal spacing of the folding stations, substantially all the seats on the wheel between the loading and unloading stations house unfinished packets, stoppage of the packing machine, even for only a few seconds, automatically results in rejection of a relatively large number of packets, due to the gum on the sheets of wrapping material drying and so preventing the packets from being completed.

SUMMARY OF THE INVENTION

It is an object of the present invention to provide a wrapping method designed to overcome the aforementioned drawback.

According to the present invention, there is provided a wrapping method for producing packets comprising an inner packet and a substantially cup-shaped outer wrapping partially enclosing the inner packet; the method comprising the stages of transferring each inner packet to a respective seat on a wrapping conveyor at a transfer station and together with a gummed sheet of wrapping material folded in a U about the inner packet; and folding the sheet of wrapping material about the inner packet as said seat is fed in steps from the transfer station to an unloading station located a given number of steps from the transfer station; said folding stage comprising a first substage wherein two lateral portions of the sheet are folded one on to the other to form a tubular wrapping, and a second substage wherein an end portion of the tubular wrapping is folded to define an end wall of the tubular wrapping; the method being characterized in that said folding stage is performed as of the transfer station, and as said seat travels along a path portion extending over a relatively small number of steps in relation to said given number of steps.

According to a preferred embodiment of the above method, the sheet of wrapping material is fed to the transfer station by a supply device adjacent to the conveyor and of a given size; said path portion extending between the transfer station and a finish folding station separated from the transfer station by a minimum number of steps compatible with said size.

Said folding stage in the above method preferably comprises a given number of operations, a first number of which are performed at the transfer station, and the remaining number of which are performed at the finish folding station.

BRIEF DESCRIPTION OF THE DRAWINGS

A non-limiting embodiment of the present invention will be described by way of example with reference to the accompanying drawings, in which:

FIG. 2 shows successive stages in the folding cycle performed by a detail in FIG. 1;

DETAILED DESCRIPTION OF THE INVENTION

Figure 1:
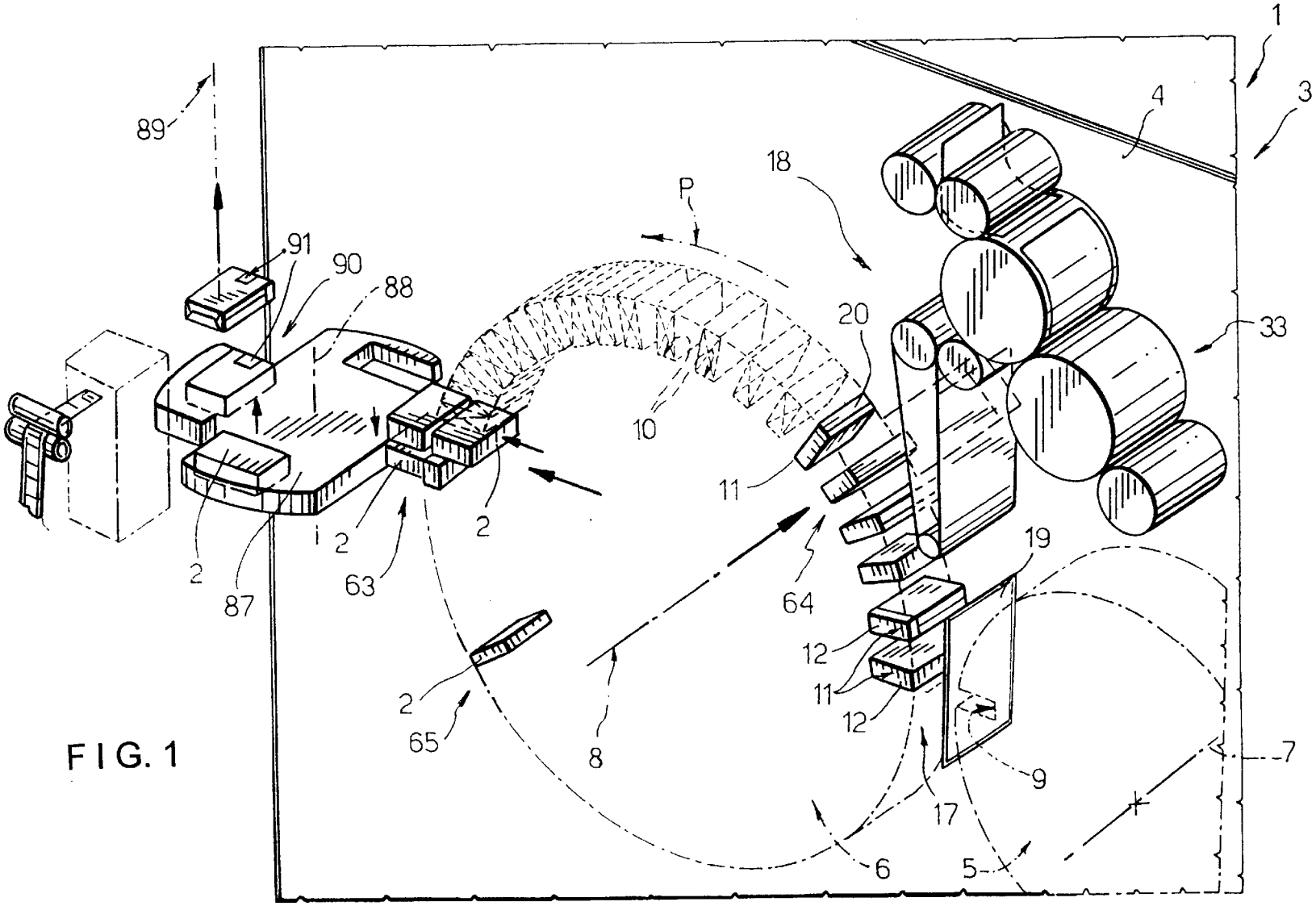
FIG. 1 shows a schematic view in perspective, with parts removed for clarity, of a packing machine implementing the method according to the present invention.

Numeral 1 in FIG. 1 indicates a packing machine for producing soft packets 2 of cigarettes, and comprising an output portion 3 having a substantially vertical frame 4 fitted with two conveyor wheels 5 and 6 rotating in steps, in time with each other, and respectively clockwise and anticlockwise about respective substantially horizontal axes 7 and 8 perpendicular to frame 4.

Wheels 5 and 6 are each provided with a plurality of peripheral, axially extending through seats 9 and 10, each for housing a group of cigarettes (not shown) having a wrapping 11 normally made of foil and defining, with the respective group of cigarettes (not shown), a packet 12 in the form of a rectangular parallelepipedon and hereinafter referred to as an "inner packet". More specifically, and as shown more clearly in FIG. 2, each inner packet 12 presents two parallel large lateral surfaces 13; two parallel small lateral surfaces 14 perpendicular to surfaces 13; a longitudinal axis 15 parallel to surfaces 13 and 14; and two end surfaces 16 perpendicular to axis 15. As shown in FIG. 1, when housed inside a respective seat 9, 10, each inner packet 12 is positioned with its axis 15 parallel to axes 7 and 8, with surfaces 13 positioned radially in relation to the respective wheel 5, 6, with one of surfaces 14 facing the bottom of respective seat 9, 10, and with the other surface 14 facing outwards.

Wheels 5 and 6 are substantially tangent to each other at a transfer station 17 where known push members (not shown) successively engage and transfer inner packets 12 from a seat 9 arrested in station 17, to a seat 10 also arrested in station 17 and facing seat 9.

As shown in FIG. 1, output portion 3 of machine 1 also comprises a known device 18 for supplying station 17—at such a location as to interfere with respective inner packets 12 being transferred from wheel 5 to wheel 6—with a succession of substantially rectangular sheets 19 of wrapping material, each of which is folded about a respective inner packet 12 to define a wrapping 20 at least partly enclosing inner packet 12.

As shown more clearly in FIG. 2*g*, wrapping 20 is substantially cup-shaped, and comprises two large lateral walls 21 partly covering surfaces 13 of inner packet 12; two small lateral walls 22 perpendicular to walls 21 and partly covering surfaces 14 of inner packet 12; and an end wall 23 contacting one of surfaces 16 of inner packet 12.

Each sheet 19 is folded about respective inner packet 12 according to the sequence shown in FIG. 2, whereby, on being inserted inside seat 10, inner packet 12 takes with it and folds into a U a respective sheet 19 located in station 17. More specifically, sheet 19 is inserted inside seat 10 so as to contact the bottom of it, and so as to present a U-shaped end portion 24 projecting axially, and two lateral portions 25 and 26 projecting radially from seat 10. Portions 25 and 26 are then folded, the first on top of the second, to form a tubular wrapping 27 (FIG. 2*d*), the end portion of which corresponding to end portion 24 projects beyond the axial surface 28 of wheel 6 facing frame 4, and comprises two large tabs 29 and 30, a small inner tab 31, i.e. facing axis 8, and a small outer tab 32 parallel to tab 31 and perpendicular to tabs 29 and 30. Finally, tabs 31 and 32 are folded on to surface 16, and tabs 29 and 30 are folded, the first on top of the second, to define, with tabs 31 and 32, the end wall 23 of wrapping 20.

Before reaching station 17, each sheet 19 is fed through a known gumming unit 33 which provides for gumming given parts (not shown) of sheet 19 to obtain a wrapping 20 of firm shape.

As shown in FIGS. 3, 4, 5 and 7, for each seat 10, surface 28 of wheel 6 presents a folding device 34 for squarely folding tab 31, and a compacting pad device 35 for maintaining squarely folded tabs 29–32 contacting one another and so stabilizing end wall 23 of wrapping 20.

Figure 5:
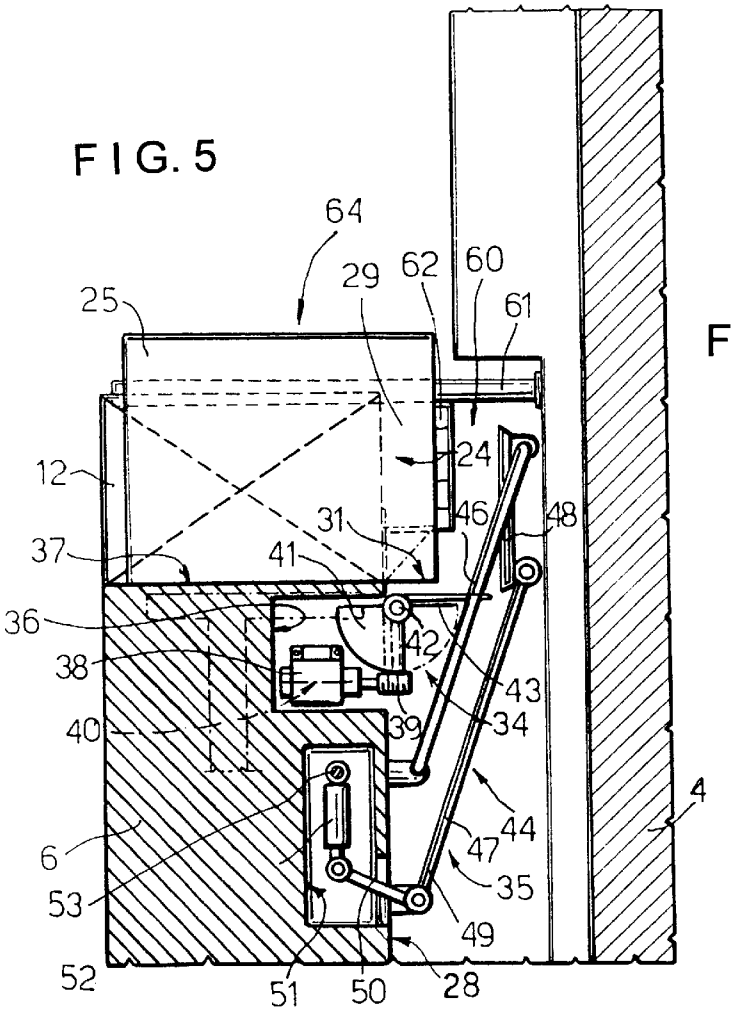
FIG. 5 shows a section along line V—V in FIG. 4.

As shown for example in FIG. 5, each folding device 34 is housed partly inside a cavity 36 formed through surface 28 just inwards of the bottom surface 37 of seat 10, and comprises a motor 38, the output shaft of which is fitted with a worm 39 positioned with its axis 40 perpendicular to surface 28, and projecting partly outwards of cavity 36 to engage a sector gear 41. Sector gear 41 is mounted for rotation about a pin 42 which is integral with wheel 6, is fitted to surface 28 close to surface 37 and perpendicular to axis 8, and is fitted with a folding blade 43 movable with sector gear 41 between an idle position (FIG. 5) wherein blade 43 projects from surface 28 towards frame 4, and an operating position (FIG. 7) at 90° to the idle position and wherein blade 43 is positioned facing seat 10 and substantially coplanar with surface 28.

Figure 7A:
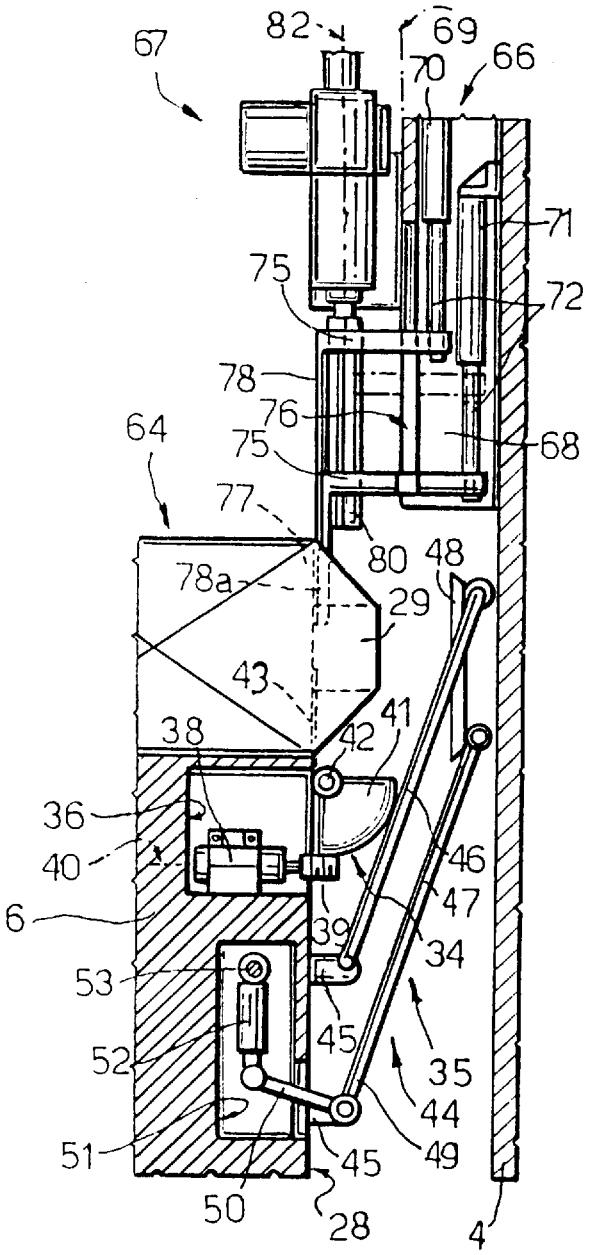
FIG. 7 shows a section along line VII—VII in FIG. 6.
Figure 7B:
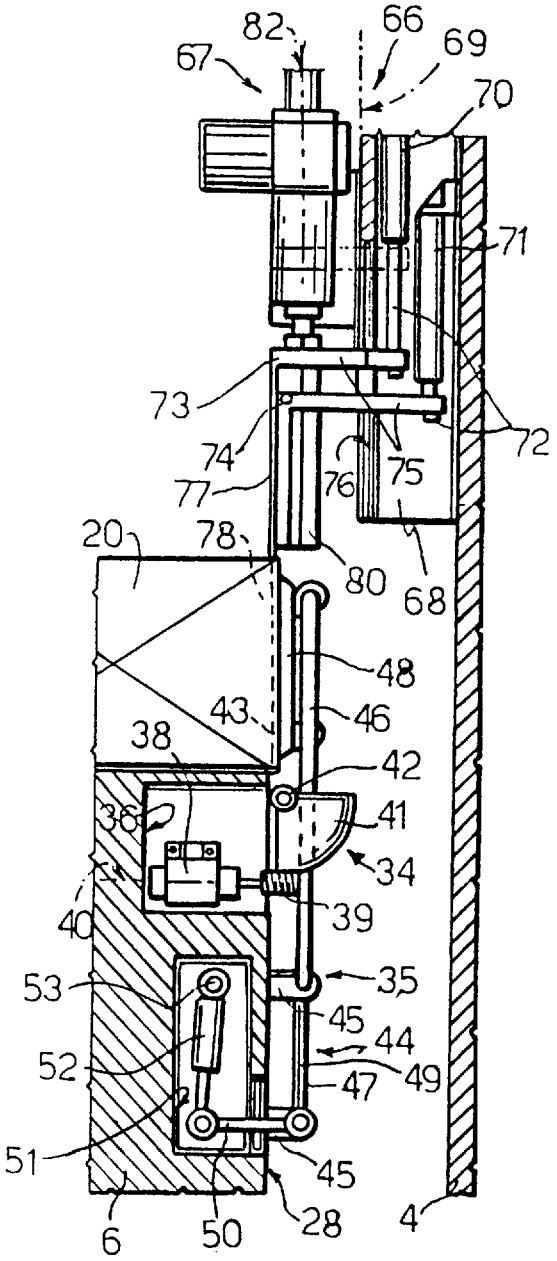

As shown for example in FIG. 7, compacting device 35 comprises an articulated parallelogram 44, the frame of which is defined by two brackets 45 projecting from surface 28 towards frame 4 and to which are hinged respective cranks 46 and 47. The free ends of cranks 46 and 47 are connected to each other by a pad defined by a plate 48 optionally provided with heating elements (not shown) and movable, parallel to surface 28, between an idle position (FIG. 7*a*) raised in relation to surface 28, and an operating position (FIG. 7*b*) wherein plate 48 is positioned facing seat 10 and coplanar with surface 28. Crank 47 defines one arm of a square rocker arm 49, the other arm 50 of which is housed inside a cavity 51 formed through surface 28 and housing a linear actuator 52, one end of which is hinged to the free end of arm 50, and the other end of which is hinged to wheel 6 so as to rotate, in relation to wheel 6, about a pin 53 parallel to pin 42.

Figures 3A, 3B, 3C:
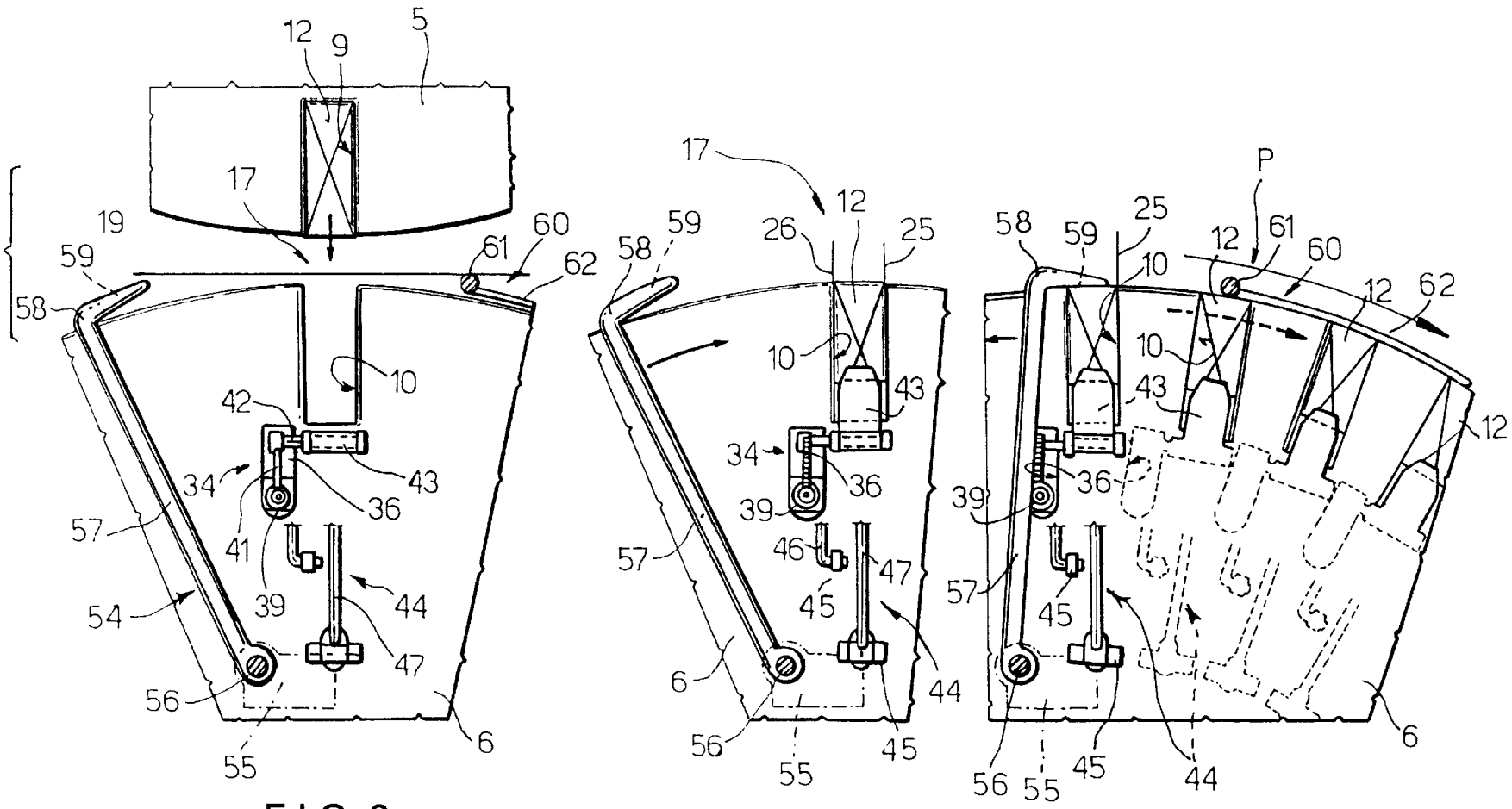
FIG. 3 shows an enlarged front view of a FIG. 1 detail in three different operating positions.
Figure 4:
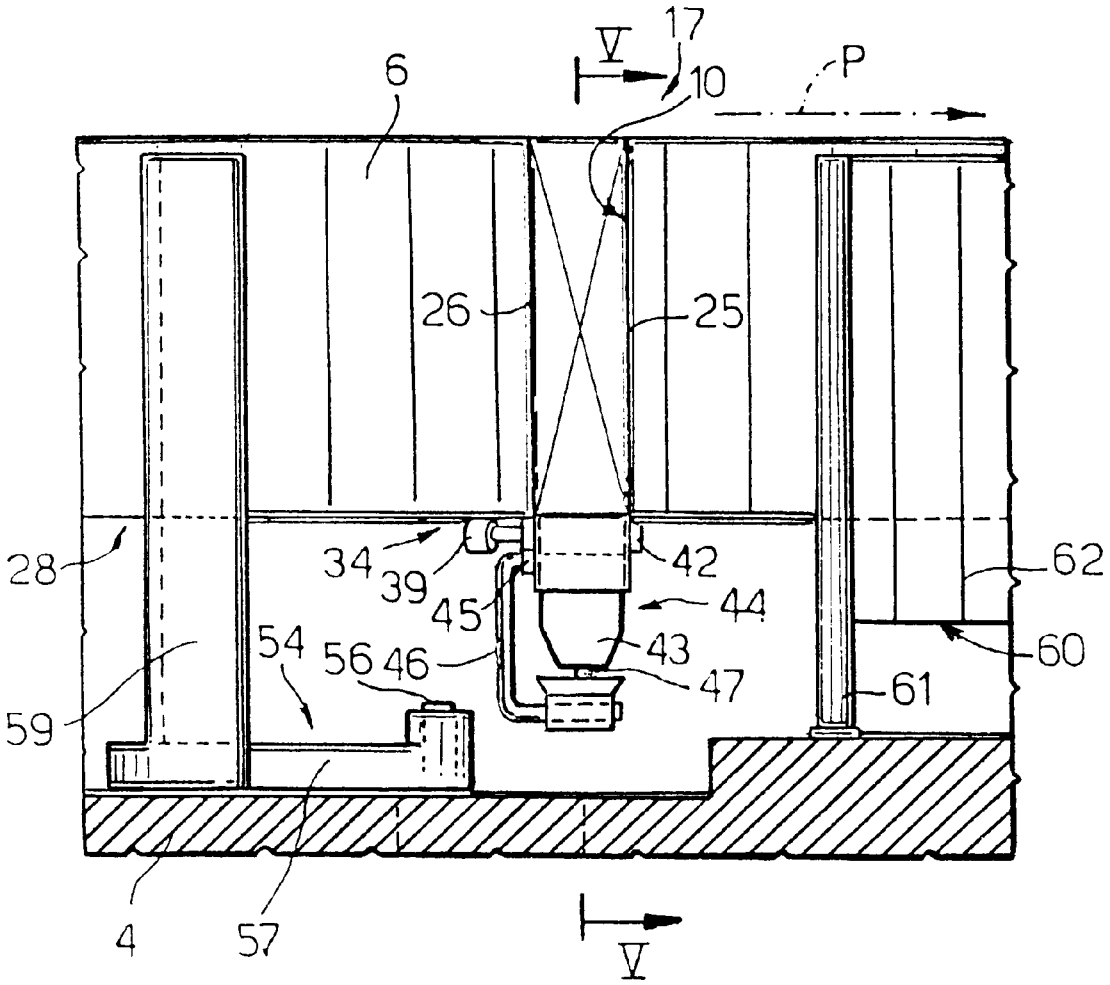
FIG. 4 shows an enlarged plan view of the FIG. 3 detail.
Figure 6:
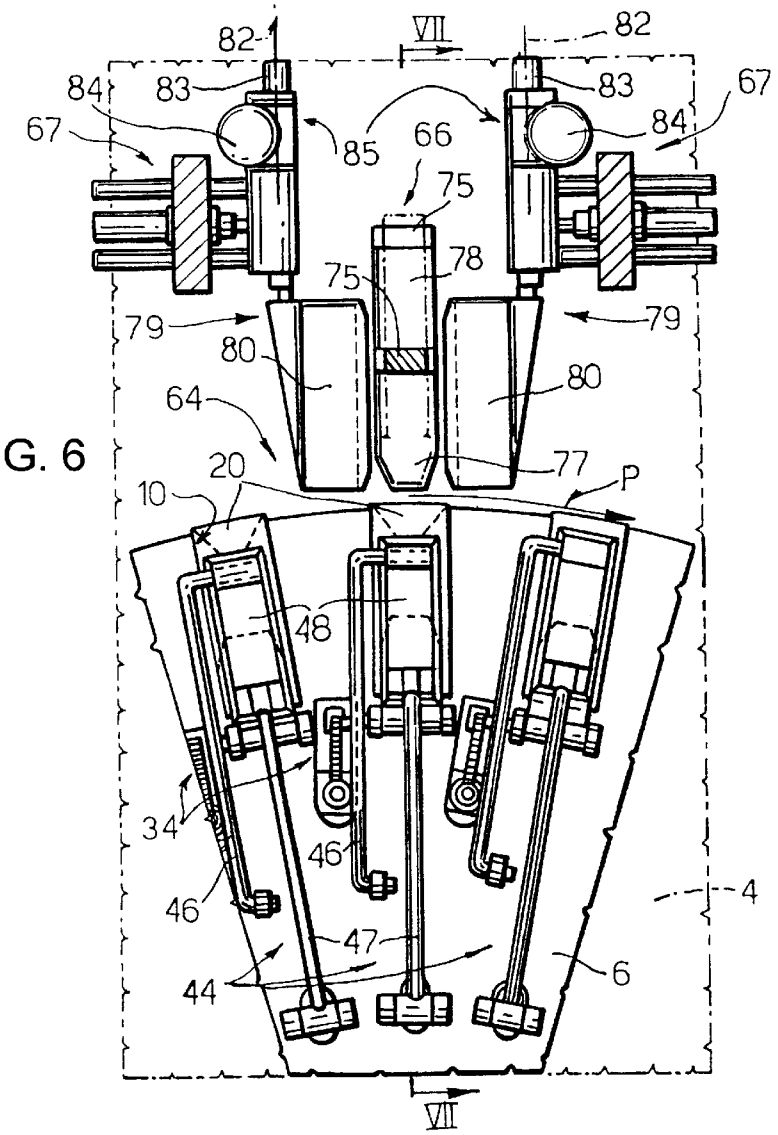
FIG. 6 shows an enlarged rear view of a detail in FIG. 1.

As shown for example in FIGS. 3 and 4, at transfer station 17, frame 4 supports a movable folding device 54 comprising a motor 55, the output shaft 56 of which projects from frame 4 towards surface 28 of wheel 6 and parallel to axis 8, and is fitted with the end of a square lever 57. Lever 57 comprises an end arm 58 fitted with a wing 59 which extends parallel to axis 8, is tangent to the outer periphery of wheel 6, and is movable between an idle position (FIGS. 3*a*, 3*b*) wherein it is located upstream from a seat 10 arrested in station 17, and an operating position (FIG. 3*c*) wherein it is positioned facing seat 10 and substantially closes the inlet of seat 10 facing wheel 5. Again with reference to FIGS. 3 and 4, just downstream from station 17, frame 4 supports a fixed folding element 60 defined by a pin 61 which is integral with frame 4, is parallel to shaft 56, and forms the input element of a fixed plate 62 extending along part of the periphery of wheel 6 downstream from station 17.

As shown in FIG. 1, the periphery of wheel 6 defines, for seats 10, a circular path P extending through transfer station 17, an unloading station 63 substantially diametrically opposite transfer station 17, a wrapping station 64 between stations 17 and 63 in the traveling direction of seats 10 along path P, and a reject station 65 between stations 63 and 17 in the traveling direction of seats 10 along path P.

Wrapping station 64 is separated from transfer station 17 by a minimum number of steps compatible with the size of supply device 18 and all the devices (not shown) of machine 1 located adjacent to wheel 6 at station 17. More specifically, the term "minimum number of steps" is intended to mean that the number of operating steps of wheel 6 between stations 17 and 64 may even be reduced to one if permitted by the arrangement of supply device 18 and said other devices (not shown), and that station 64 must be located as close as possible to station 17 and as compatible with the size of the devices already mentioned and that of the devices defining station 64 itself and described hereinafter.

In the FIG. 1 example, station 64 is located four steps downstream from station 17 along path P in the traveling direction of seats 10, and station 63 is located 14 steps downstream from station 64, namely a multiple number of times more than the number of steps between stations 17 and 64, i.e. more than three times the number of steps between stations 17 and 64. As shown in FIGS. 6 to 10, two folding devices 66 and 67 are fitted to frame 4 outwards of path P and the outer periphery of wheel 6 between stations 17 and 63.

As shown more clearly in FIG. 7, device 66 comprises a casing 68 integral with frame 4 and substantially in the form of a rectangular parallelepipedon with a radial axis 69 in relation to axis 8; and two linear actuators 70 and 71 parallel to axis 69, and the respective output rods 72 of which are fitted with respective square folding elements 73 and 74. A first arm 75 of each folding element 73, 74 extends perpendicular to the respective rod 72 and through a guide groove 76 parallel to axis 69 and formed through a wall of casing 68. In addition to respective first arms 75, folding elements 73 and 74 also comprise respective folding blades 77 and 78 integral with respective arms 75; blade 78 presents a surface substantially coplanar with surface 28, extends radially towards axis 8, and presents a thickness similar to that of blade 43; while blade 77 is thicker than and parallel to blade 78, and is located contacting the surface of blade 78 opposite that coplanar with surface 28. By means of respective actuators 70 and 71, blades 77 and 78 are movable independently, and in a radial direction in relation to axis 8, between an idle position outwards of the outer periphery of wheel 6, and an operating position wherein they are positioned facing seat 10 arrested in station 64.

Figures 8, 9, 10:
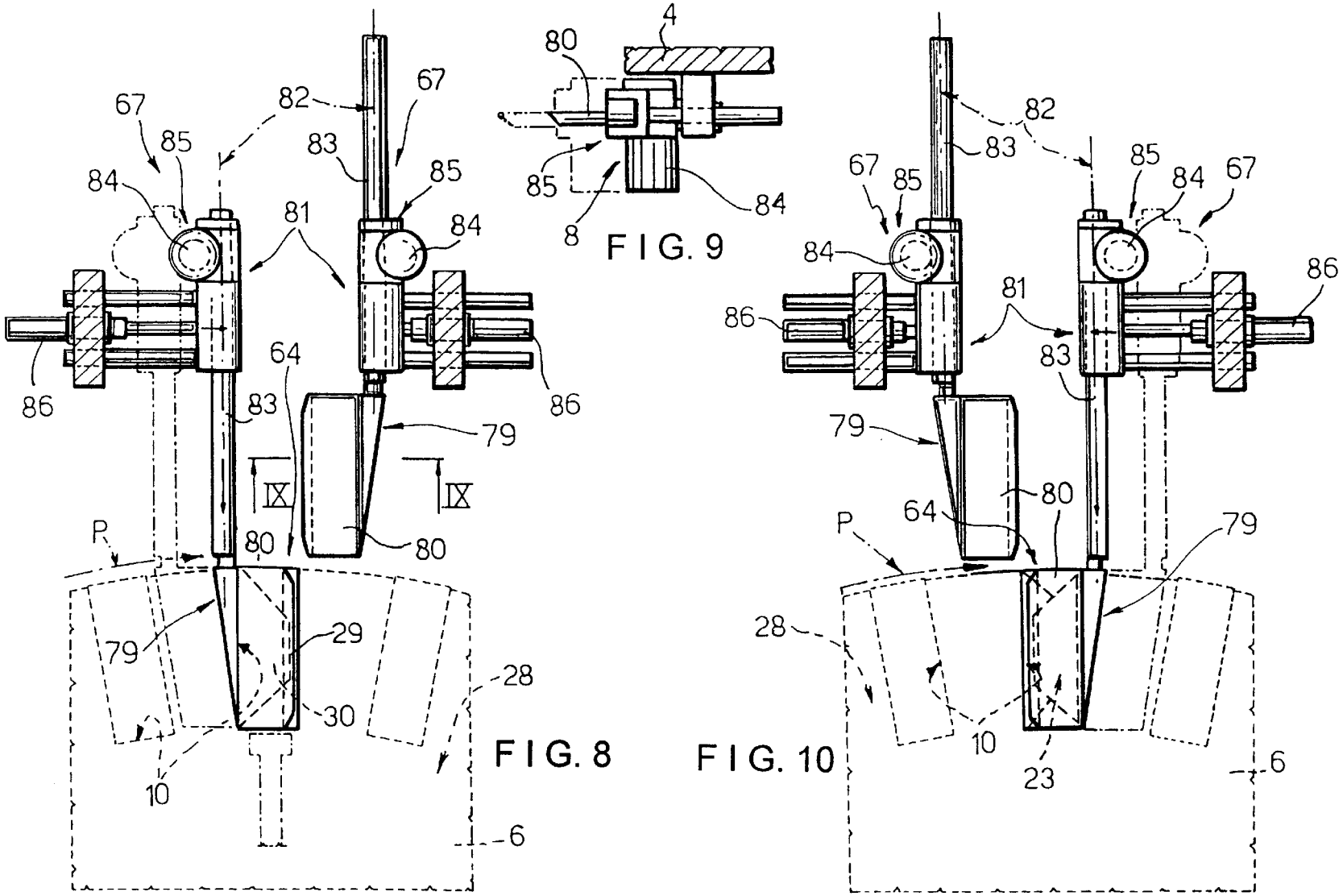
FIG. 8 shows a rear view of a FIG. 1 detail in a first operating position.
FIG. 9 shows a section along IX—IX in FIG. 8.
FIG. 10 shows a rear view of the FIG. 8 detail in a further operating position.

As shown more clearly in FIGS. 8 to 10, folding device 67 comprises two folding assemblies 79 presenting respective opposed folding tabs 80 substantially coplanar with surface 28; and each folding assembly 79 comprises a guide 81 presenting a substantially radial axis 82 in relation to axis 8, and housing in sliding manner a rod 83 coaxial with axis 82. Rod 83 is fitted integral with a respective tab 80, and is moved along guide 81 by a motor 84 connected to rod 83 by a rack-and-pinion coupling 85. Each folding assembly 79 also comprises a linear actuator 86 fitted to frame 4 outwards of the outer periphery of wheel 6 and connected to guide 81; and motor 84 and actuator 86 cooperate with each other to move respective tab 80, in the plane of surface 28, from an idle position (FIG. 6) wherein tab 80 is positioned outwards of the outer periphery of wheel 6 and to the side of a seat 10 arrested in station 64, through an intermediate position (FIGS. 8 and 10) wherein tab 80 is positioned facing surface 28 of wheel 6 and to the side of seat 10, and to an operating position (FIGS. 8 and 10) wherein tab 80 is positioned facing and closing the inner axial end of seat 10.

At unloading station 63, wheel 6 cooperates with a known wheel 87 which, rotating about an axis 88 perpendicular to axis 8, provides for successively transferring packets 2 from wheel 6 to an output path 89 substantially parallel to axis 88, and via a known station 90 where a sealing strip 91 is applied to each packet 2.

Operation of packing machine 1 will now be described with reference to one packet 12 transferred from wheel 5 to a seat 10 arrested at station 17, and together with a respective gummed sheet 19 supplied to station 17 by device 18.

As clearly deducible from the operating sequence described with reference to FIG. 2, the folding of sheet 19 to form outer wrapping 20 may be divided into two substages: a first for forming tubular wrapping 27; and a second for forming end wall 23 of outer wrapping 20. As explained more clearly later on, the first of said substages is performed entirely at transfer station 17, whereas a first part of the second substage is performed at station 17, and the rest at station 64.

On being inserted inside seat 10, packet 12 folds respective sheet 19 in a U (FIG. 2*b*) so that it is positioned inside seat 10 with its concavity facing radially outwards in relation to wheel 6, with end portion 24 projecting axially from seat 10 towards frame 4, and with portions 25 and 26 projecting radially from seat 10. Before wheel 6 feeds seat 10 forward one step along path P towards station 64, motor 55 is operated to move lever 57 into the operating position and so position wing 59 in front of seat 10 to squarely fold portion 26 (FIG. 2*c*) on to the outer surface 14 of packet 12. Simultaneously with motor 55, motor 38 of folding device 34 is operated to move blade 43 from the idle to the operating position and so squarely fold part of portion 24 (FIG. 2*c*) on to the inner surface 16 of packet 12 to define tab 31; and blade 43 is left in the operating position throughout the time taken by seat 10 to travel along the portion of path P between station 17 and reject station 65.

As wheel 6 is moved forward one step, internally gummed portion 25 cooperates with fixed pin 61 and is folded on to and adheres to portion 26 (FIG. 2*d*) to form tubular wrapping 27.

Wheel 6 then feeds packet 12 and wrapping 27 through a succession of four steps, each separated from the next by a stop, to wrapping station 64. With reference to FIGS. 2*e* and 7, as seat 10 is arrested at station 64, actuators 70 and 71 are first operated to move both blades 78 and 77 into the operating position and so squarely fold part of portion 24 of wrapping 27 (FIG. 2*e*) on to the inner surface 16 of packet 12 to define tab 32 and the two tabs 29 and 30 still parallel to axis 8. As shown in FIG. 7*b*, once tab 32 is folded, blade 77 is restored to the idle position, while blade 78 is left in the operating position.

In connection with the above, it should be pointed out that, taken together, blades 77 and 78 define a relatively thick single folding plate 78*a*, the thickness of which is such as to prevent it from punching through sheet 19 when moved into the operating position by simultaneously operating actuators 70 and 71.

During the same stop at station 64 with blade 78 in the operating position contacting tab 32, the two folding devices 67 are operated to squarely fold tabs 29 and 30 (FIGS. 2*f*, 2*g*) so that tab 29 adheres to the outer surface of tab 30, and so complete end wall 23 of wrapping 20. In this connection, it should be pointed out that blades 43 and 78 together define a folding support or spindle for tabs 29 and 30.

With seat 10 still arrested at station 64, devices 67 are again operated to restore tabs 80 to the idle position; and, with blade 78 still in the operating position, actuator 52 is operated to bring plate 48 into contact with the outer surface of wall 23 and so compress tabs 29 and 30 between blades 43 and 78 on one side and plate 48—possibly heated—on the other, to ensure perfect adhesion of tabs 29 and 30.

Before seat 10 is moved out of station 64, blade 78 is restored to the idle position, whereas plate 48 is left in the operating position together with blade 43 throughout the time taken by wheel 6 to feed seat 10 to unloading station 63 where plate 48 is restored to the idle position, and packet 2 is unloaded radially from seat 10 by detaching it from blade 43 which, as stated, remains in the operating position until seat 10 passes reject station 65.

Obviously, in the event known control devices (not shown) detect a faulty packet 2 inside any one of seats 10 between stations 64 and 63, the faulty packet, as opposed to being unloaded by wheel 6 at station 63, is not unloaded until the respective seat 10 is arrested at reject station 65, thus saving a sealing strip 91.

Clearly, therefore, all the folding operations of sheet 19 are concentrated partly at station 17 and partly at station 64; all the seats 10 on wheel 6 between stations 17 and 63 contain finished packets 2 with the exception of seats 10 between stations 17 and 64; and, in view of the minimum number of steps, and hence seats 10, between stations 17 and 64, a minimum number of incomplete packets 2 will be rejected in the event of a stoppage of machine 1.

What is claimed is:

1. A wrapping method for producing a packet comprising an inner packet and a substantially cup-shaped outer wrapping partially enclosing the inner packet; the method comprising transferring the inner packet to a respective seat on a wrapping conveyor at a transfer station together with a gummed sheet of wrapping material folded in a U-shape about the inner packet; folding, substantially at said transfer station, two lateral portions of the sheet, one on the other, and about the inner packet to form a tubular wrapping enclosing the inner packet; step advancing for a first given number of steps said seat from said transfer station to a fold-finishing station; folding, substantially at said fold-finishing station, the sheet of wrapping material about the inner packet by folding an end portion of the tubular wrapping by folding means to define a folded end wall of the tubular wrapping; moving a compression member into contact with said folded end wall of the tubular wrapping for maintaining said end portion in a folded position; step-advancing for a second given number of steps said seat together with said compression member from said fold-finishing station, to an unloading station while maintaining said compression member in contact with said folded end wall of the tubular wrapping; and unloading said packet from the conveyor at said unloading station; said second given number of steps being a multiple of said first given number of steps.

2. A method as claimed in claim 1, wherein said second given number of steps is at least three times said first given number of steps.

3. A method as claimed in claim 1, wherein said folding said end portion comprises forming and squarely folding four tabs; a first of said tabs being formed and folded at said transfer station.

4. A method as claimed in claim 3, wherein said first tab is folded prior to completing the formation of said tubular wrapping.

5. A method as claimed in claim 4, wherein said first tab is folded by a folding device moving with said wrapping conveyor.

6. A method as claimed in claim 5, wherein said folding device is moved in relation to the wrapping conveyor between an idle position and an operating position.

7. A method as claimed in claim 6, wherein said folding device comprises a relatively thin blade which, in the operating position, is positioned in contact with said first tab folded squarely; and maintaining said folding device in the operating position at least from said transfer station to said fold-finishing station.

8. A method as claimed in claim 3, wherein said folding said end portion further comprises forming and squarely folding a second tab opposite said first tab; said second tab being formed and folded at said fold-finishing station.

9. A method as claimed in claim 8, wherein said second tab is folded by said folding means which comprises first and second blades located on said fold-finishing station and moving in relation to the wrapping conveyor between an idle position and an operating position, and in relation to each other between an offset position and a superimposed position; said second tab being folded by moving the two blades into the operating position and maintaining the blades in the superimposed position.

10. A method as claimed in claim 1, wherein a folding support across an axial end of said seat is defined before bringing said compression member into contact with said end wall; said compression member pressing two opposite, partially superimposed said tabs against said support.

11. A method as claimed in claim 10, wherein said compression member comprises pad means moving with the wrapping conveyor and moving in relation to the wrapping conveyor between an idle and an operating position; and maintaining said pad means in the operating position up to said unloading station.

12. A method as claimed in claim 1, wherein said first given number of steps is more than one.

13. A method as claimed in claim 1, wherein said first given number of steps is four.

* * * * *